US005427027A

United States Patent [19]

Kato et al.

[11] Patent Number: 5,427,027

[45] Date of Patent: Jun. 27, 1995

[54] PRINTING DIE REPLACEMENT ASSISTING UNIT IN PRINTING APPARATUS

[75] Inventors: Shunji Kato, Kasugai; Toshiyuki Natsume, Nagoya, both of Japan

[73] Assignee: Kabushiki Kaisha Isowa, Aichi, Japan

[21] Appl. No.: 225,608

[22] Filed: Apr. 11, 1994

[30] Foreign Application Priority Data

Apr. 16, 1993 [JP] Japan ..... 5-025258

[51] Int. Cl.[6] ..... B41F 1/28

[52] U.S. Cl. ..... 101/477

[58] Field of Search ..... 101/477, 216, 415.1; 198/485.1, 486.1, 408, 410, 399; 274/225, 185

[56] References Cited

U.S. PATENT DOCUMENTS 2,039,072 4/1936 Dugdale ..... 101/477

5,323,699 6/1994 Motoe et al. ..... 101/477

*Primary Examiner*—Eugene H. Eickholt

*Attorney, Agent, or Firm*—Koda and Androlia

[57] ABSTRACT

Disclosed is a printing die replacement assisting unit for facilitating die replacement by an operator in a printing apparatus having a plate cylinder rotatably supported in the main body of the apparatus with a printing die having engagement plates being mounted on the circumference of the plate cylinder, the printing die replacement assisting unit comprising a support frame disposed on the main body, with a fitting member being descendably supported on supporting means disposed on the support frame; holding means disposed to the fitting member, which can releasably hold one of the engagement plates of the printing die; and an urging means connected to the supporting means, which normally urges the means in the direction such that the fitting member may be ascended, but allows pulling down of the fitting member; wherein the printing die is designed to be held by and suspended from the fitting member via the holding means.

7 Claims, 8 Drawing Sheets

PRINTING DIE REPLACEMENT ASSISTING UNIT IN PRINTING APPARATUS

BACKGROUND OF THE INVENTION

1. Field of the Invention

This invention relates to a printing die replacement assisting unit in a printing apparatus for applying a predetermined print on corrugated board sheets, in which the printing die mounted around the plate cylinder can easily be replaced.

2. Description of the Related Art

The printing apparatus which applies a print on corrugate board sheets cut into a predetermined length is provided with a plate cylinder and an impression cylinder arranged in a vertical relationship, i.e. at an upper position and a lower position with respect to the corrugated board sheet pass line, and a desired printing die is designed to be removably mounted around the plate cylinder. An ink is transferred to the printing die with the aid of an ink transfer mechanism disposed above the plate cylinder, and a corrugated board sheet is passed between the plate cylinder and the impression cylinder to apply a required print on the sheet.

An engagement groove and a clamping groove are formed on the circumference of the plate cylinder parallelwise in the axial direction, with a clamp being disposed in the clamping groove. When the printing die is to be mounted on the circumference of the plate cylinder, one of the engagement plates disposed at the end portions of the printing die relative to the die rolling direction is engaged in the engagement groove, and the plate cylinder is then turned to roll the printing die therearound. After the printing die is substantially rolled around the plate cylinder, the other engagement plate of the printing die is clamped and tightened by the clamp disposed in the clamping groove, whereby the printing die can be mounted on the circumference of the plate cylinder.

In such printing apparatus, when the printing die (old printing die) mounted around the plate cylinder is to be replaced in accordance with an order change with another printing die (new printing die) of the next order, an operator first releases the old printing die mounted around the plate cylinder and lays it on the floor or somewhere else. After the operator puts one engagement plate of the new printing die in the engagement groove of the plate cylinder, he holds the free end portion of the new printing die and turns the plate cylinder, whereby the new printing die is rolled around the plate cylinder. After the other engagement plate of the new printing die is clamped by the clamp disposed in the clamping groove, the new printing die is tightened by the clamp to complete the replacement operation.

In this case, when the printing die, one engagement plate thereof being caught in the engagement groove of the plate cylinder, is to be mounted around the plate cylinder, it is not so difficult for one operator to hold the free end portion of the printing die, so long as the width of the printing plate (length in the axial direction of the plate cylinder) is small. However, if the printing die is wide, it is too tough for one operator to hold such heavy printing die so as to cope with such operation, forcing overburden on the operator and reducing operation efficiency, disadvantageously. Thus, in carrying out replacement of a wide printing die, the free end portion of the printing die is generally held by two operators on each side of the printing die. However, increase in the labor cost can be pointed out in this case. Besides, the old printing die released from the plate cylinder must be placed on the floor on which a new printing die has already been provided, so that the floor is occupied by two printing dies to interfere with the replacing operation, disadvantageously.

In order to overcome such problems, Japanese Unexamined Patent Publication Nos. 133069/1982 and 133070/1982 disclose systems. In these systems, a printing die replacing unit is disposed adjacent to the printing apparatus so as to carry out removal of the old printing die from the plate cylinder and mounting of the new printing die therearound automatically in accordance with order changes.

However, it can be pointed out that a complicated mechanism must be employed in these systems, leading to cost elevation, disadvantageously. In addition, a space must be secured for installing the large replacing unit, so that the space in the factory cannot effectively be utilized. Moreover, it can also be pointed out, in order to cope with the automation of printing die replacement with the aid of the printing die replacing unit, that special working must be applied to the printing dies and the plate cylinder, that special jigs must be provided, and that the facility investment for the automation jumps up, disadvantageously. Accordingly, such systems can hardly be utilized in actual applications.

SUMMARY OF THE INVENTION

Under such circumstances, the present inventor made intensive studies and discussions with a view to overcoming these problems to be convinced that the demand of users can fully be satisfied even if the printing die replacement is carried out manually instead of using an automatic printing die replacing unit, so long as labor saving in the replacing operation can be realized at low cost.

Namely, the present invention is proposed in view of the problems inherent in the prior art described above and for solving them successfully, and it is an object of the invention to provide an inexpensive printing die replacement assisting unit which assists the operation of printing die replacement to be carried out by an operator and which can achieve both simplification of the operation and labor saving.

In order to overcome the above problems and attain the intended objects, this invention provides a printing die replacement assisting unit for a printing apparatus in which a plate cylinder is rotatably supported in the main body of the apparatus with a printing die having engagement plates on each end portion with respect to the rolling direction being mounted on the circumference of the plate cylinder, the printing die replacement assisting unit comprising: a support frame disposed on the main body, with a fitting member being descendably supported on supporting means disposed on the support frame; holding means disposed to the fitting member, which can releasably hold one of the engagement plates of the printing die; and an urging means connected to the supporting means, which normally urges the means in the direction such that the fitting member may be ascended, but allows pulling down of the fitting member; wherein the printing die is designed to be held by and suspended from the fitting member via the holding means.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF THE INVENTION

The printing die replacement assisting unit according to this invention will now be described by way of preferred embodiments referring to the attached drawings. It should be noted here that the printing die replacement assisting unit of the invention is to be disposed in the printing apparatus. Therefore, for helping better understanding of the invention, a printing apparatus employed in the flexographic printer-slotter is given here as an example, and the schematic constitution thereof will first be described.

Figure 4:
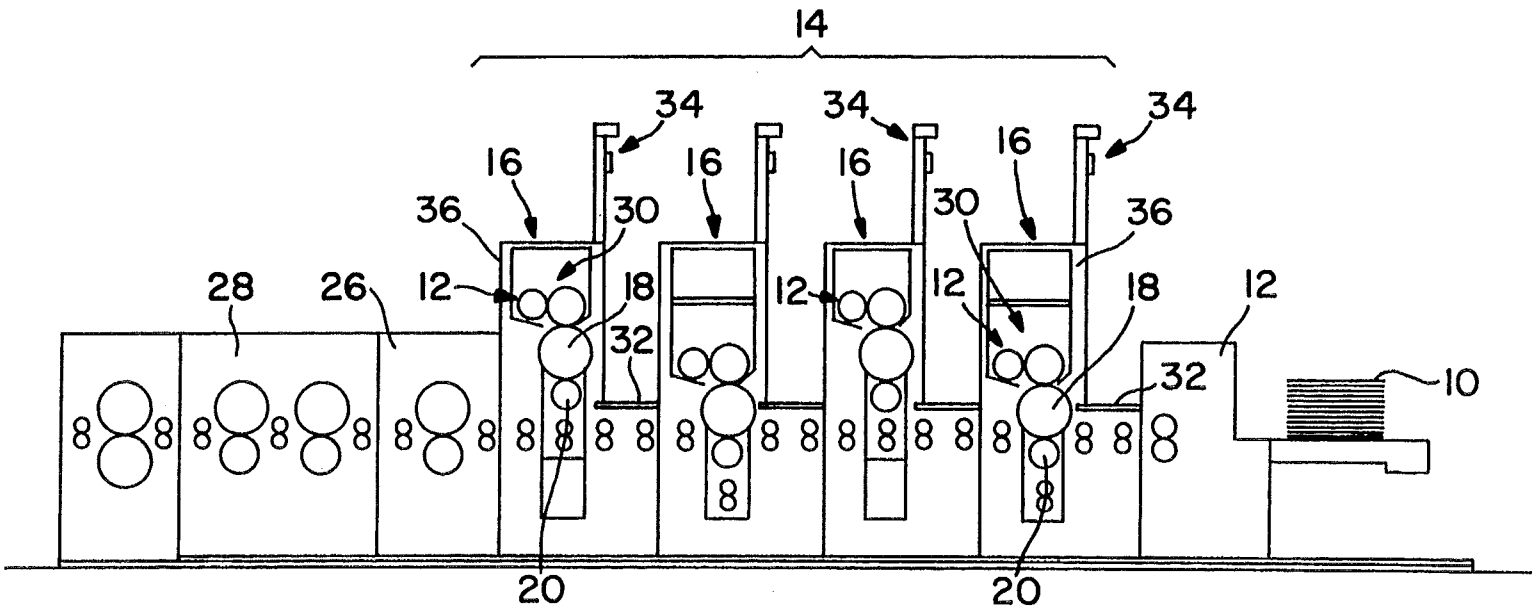
FIG. 4 is an explanatory view showing schematically the constitution of a flexographic printer-slotter in which the printing die replacement assisting unit according to the first embodiment of the invention is employed.

FIG. 4 shows a schematic constitution of the flexographic printer-slotter, in which a number of corrugated board sheets 10 cut into a predetermined length are stacked and stored in a sheet feeder 12, and they are fed out one by one horizontally by a kicker (not shown) provided in the feeder 12 toward a flexographic printer 14 disposed downstream.

The flexographic printer 14 consists of a plurality of printing units 16 of exactly the same constitution arranged serially which apply flexographic prints of desired colors when the corrugated board sheet 10 passes through the respective printing units 16. Each printing unit 16 is provided with a rotatable plate cylinder 18 and a rotatable impression cylinder 20 in a vertical relationship, i.e. at an upper position and a lower position with respect to the pass line of the corrugated board sheet 10. An ink feeding mechanism 22 is disposed above the plate cylinder 18, so that a predetermined amount of ink may be fed to a predetermined printing die 24 removably mounted on the circumference of the plate cylinder 18. The corrugated board sheet 10 is passed through the printing section defined between the plate cylinder 18 and the impression cylinder 20 to be applied with a predetermined print thereon. The thus printed corrugated board sheet 10 is fed to a creaser 26 disposed downstream to be subjected to a desired creasing process and then to a slotter 28 to be subjected to a desired slotting process.

A printing mechanism 30, consisting of the plate cylinder 18, impression cylinder 20, ink feeding mechanism 23, etc., disposed in each printing unit 16 is designed to be ascended or descended by a lift (not shown) so as to move the plate cylinder 18 and the impression cylinder 20, in terms of the pass line, between the operational position where printing is applied to the corrugated board sheet 10 (the state of the first and third units counted downstream in the sheet feeding direction) and the halt position where no printing is applied to the corrugated board sheet 10 (the state of the second and fourth units counted downstream in the sheet feeding direction). Replacement of the printing dies 24 in the corresponding printing mechanisms 30 is carried out while they are at the halt positions. Steps 32 are provided between the respective printing units 16, and the operator climbs on such step 32 so as to carry out replacement of the printing die 24. Incidentally, the constitution of the plate cylinder 18 and that of the printing die 24 are the same as in the prior art, and the plate cylinder 18 has an engagement groove **18*a* and a clamping groove 18*b* in which a clamp (not shown) is provided (see FIG. 5), while engagement plates 24*a* are disposed on each end portion of the printing die 24 (see FIGS. 1 and 3**).

As shown in FIG. 4, printing die replacement assisting units 34 are disposed above the printing units 16 via supporting frames 33, respectively, as shown in FIG. 4, so that printing die replacement can easily be carried out in a short time with the aid of these assisting units.

Figure 1:
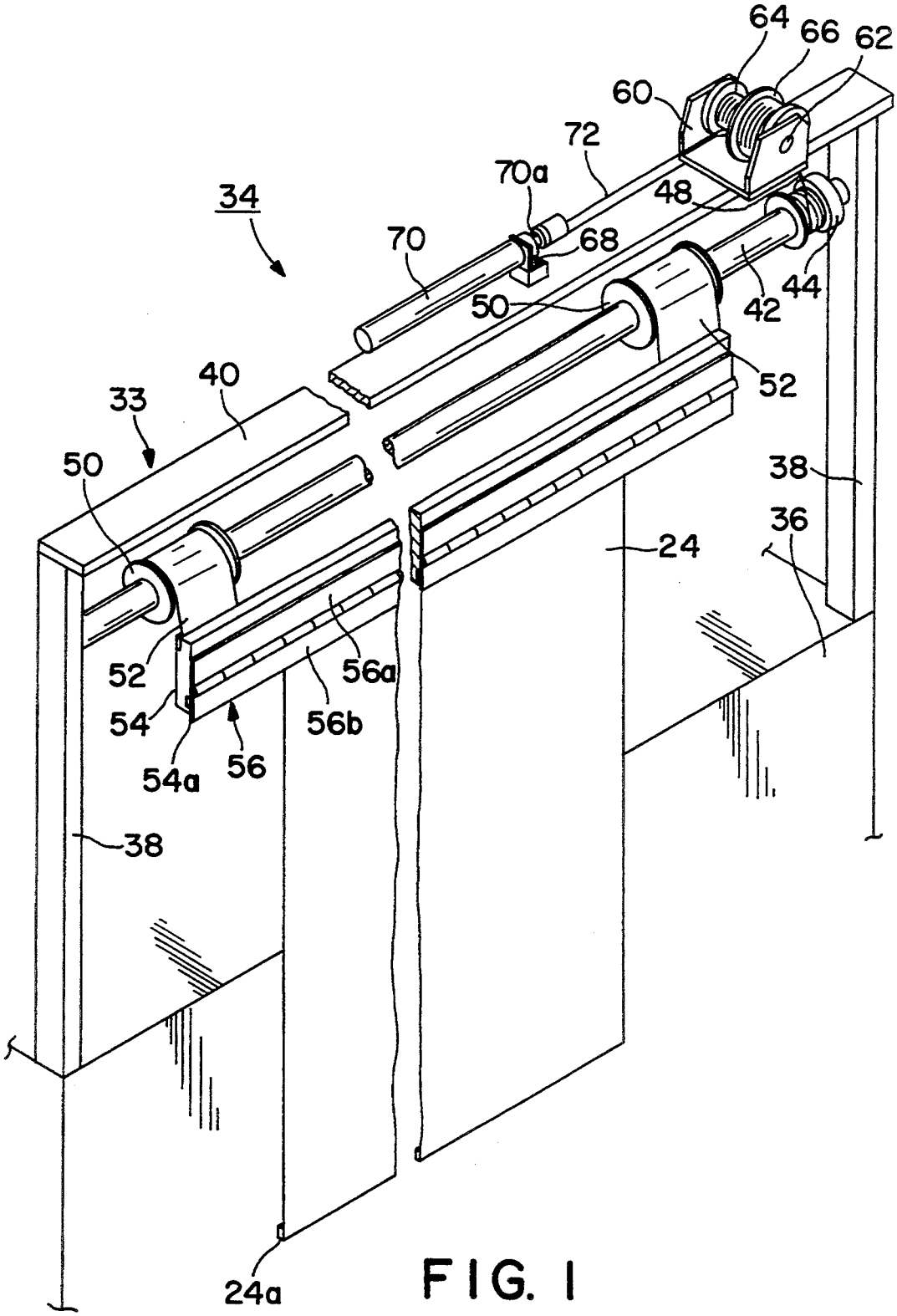
FIG. 1 shows schematically a perspective view of the printing die replacement assisting unit according to a first embodiment of the invention.

More specifically, a pair of struts 38 stand on the upper surface of the main body frame 36 of each printing unit 16 to oppose each other and to be spaced in the axial direction of the plate cylinder 18 at the edge facing the corresponding step 32, as shown in FIG. 1, with a support plate 40 being extended between these two struts 38 to constitute a gate-shaped support frame 33. A support shaft 42 is rotatably supported between the struts 38 of the support frame 33 at a predetermined level lower than the support plate 40. A reel 44, which is designed to be rotated integrally with the support shaft 42, is disposed near one longitudinal end portion of the support shaft 42. It should be noted that one end portion of a wire 48 drawn from a second reel 66 (to be described later) is connected to the reel 44 to be wound therearound in a predetermined length.

Figure 2:
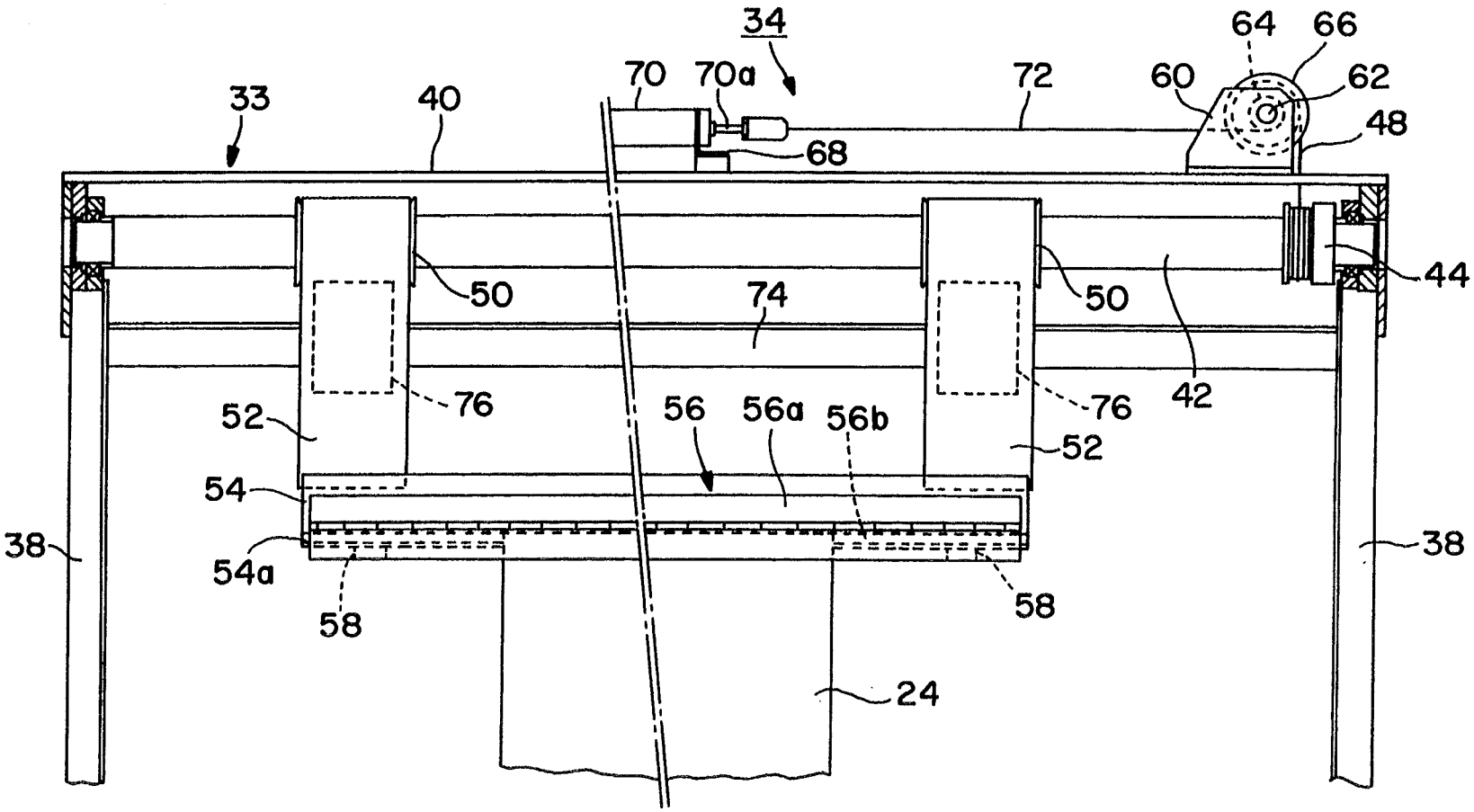
FIG. 2 shows a front view of the printing die replacement assisting unit according to the first embodiment of the invention.

As shown in FIG. 2, a pair of take-up spools 50 are fitted on the support shaft 42 at a predetermined interval in the axial direction so that they can be rotated integrally with the support shaft 42. A predetermined length of belt 52 is wound around each take-up spool 50, and the outer end portion of the belt 52 is fixed to the corresponding longitudinal end portion of a long fitting plate 54. Namely, the fitting plate 54 is held by and suspended from the pair of belts 52, as shown in FIG. 2. The fitting plate can be descended (see FIG. 6) or ascended (see FIG. 8) by drawing the belts 52 from the take-up spools 50 or winding them therearound. When the belts 52 are to be drawn from the take-up spools 50, the wire 48 wound around the second reel 66 is designed to be taken-up on the reel 44 which rotates integrally with the support shaft 42.

A hinge 56 is fixed at one leaf (fixed leaf) **56*a* thereof on the front surface (the surface facing the step 32) of the fitting plate 54 along the entire length thereof with screws (not shown), with the other leaf (movable leaf) 56*b* thereof being adapted to be pivotable on the pivot thereof and to be suspended along the front surface of the fitting plate 54. Incidentally, the movable leaf 56*b* is designed to have a width such that the lower edge thereof may locate at a predetermined level lower than the lower edge of the fitting plate 54**.

Figure 3:
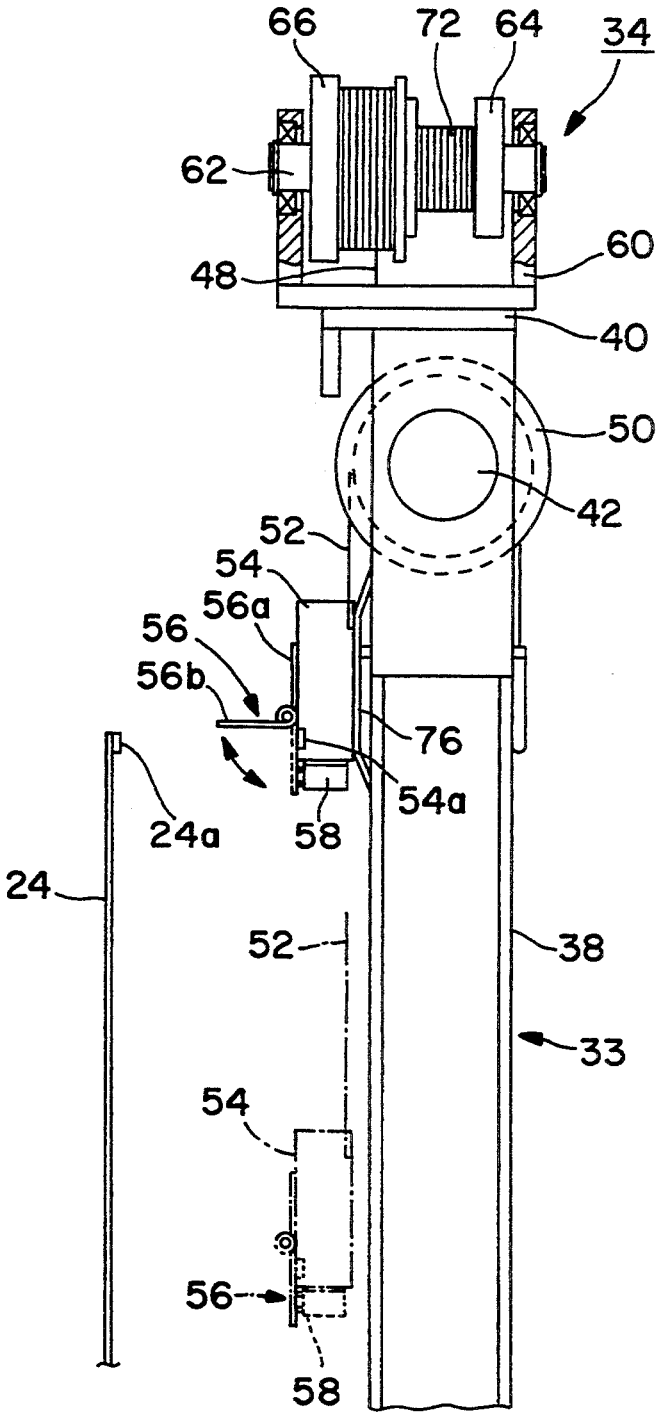
FIG. 3 shows a side view of the printing die replacement assisting unit according to the first embodiment of the invention.

An elongated groove **54*a* is formed on the fitting plate 54 over the entire length thereof in the zone covered by the movable leaf 56*b*, as shown in FIG. 2, so that the engagement plate 24*a* disposed to the printing die 24 may disengageably be caught therein. A plurality of magnets 58 (two magnets in this embodiment) are disposed to the lower end portion of the fitting plate 54 at a predetermined interval in the longitudinal direction to magnetically attract thereon the movable leaf 56*b* of the hinge 56 as abutted against the front surface of the fitting plate 54. Namely, as shown in FIG. 3, after the movable leaf 56*b* is pivoted to be spaced from the front surface of the fitting plate 54 so as to open the elongated groove 54, the engagement plate 24*a* disposed to one end portion of the printing die 24 is engaged in the elongated groove 54*a* in this state, and then the movable leaf 56*b* is allowed to be magnetically attracted by the magnets 58, whereby the printing die 24 is held at the upper end portion between the fitting plate 54 and the movable leaf 56*b*** and suspended therefrom.

When the printing die 24 held on the fitting plate 54 is pulled down so as to carry out replacement of the printing die 24, the belts 52 are drawn from the take-up spools 50 to descend the fitting plate 54, and the support shaft 42 and the reel 44 also rotate integrally with the rotation of the take-up spools 50.

As shown in FIGS. 1 and 2, a holder 60 is disposed on the upper surface of the support plate 40 at a position above the reel 44 fitted on the support shaft 42, and a shaft 62 is rotatably supported on this holder 60. A small-diameter first reel 64 and a large-diameter second reel 66 are coaxially fitted on the shaft 62 in such a way that these two reels 64,66 may be rotated integrally with the shaft 62. The wire 48 is wound around the second reel 66 in a predetermined length, and one end portion of the wire 48 drawn from the second reel 66 is connected to the reel 44. The wire 48 wound around the second reel 66 is designed to be taken up on the reel 44 when the fitting plate 54 is pulled down together with the printing die 24, as described above.

An air cylinder 70 is disposed on the support plate 40 at an appropriate position via a bracket 68 to be parallel to the longitudinal direction of the support plate 40, and one end portion of a wire 72 wound around the first reel 64 is connected to the piston rod **70*a* of the cylinder 70. The cylinder 70 is preset in such a way that the piston rod 70*a* thereof may normally be urged to retract into the barrel, i.e. in the direction that the wire 72 is drawn from the first reel 64. The second reel 66 is designed to be rotated, when the first reel 64 is rotated by drawing the wire 72 therefrom, integrally with the first reel 64 in a direction such that the wire 48 can be taken up on the second reel 66**.

In other words, when the fitting plate 54 is pulled down together with the printing die 24 so as to carry out replacement of the printing die 24, the wire 48 wound around the second reel 66 is taken up on the reel 44 fitted on the support shaft 42, whereas the wire 72 connected at one end portion to the piston rod **70*a* of the air cylinder 70 is also taken up on the first reel 64 pulling out the piston rod 70*a* from the barrel against the urging action of the cylinder. 70. Meanwhile, when the printing die 24 is disengaged from the descended fitting plate 54 to release the fitting plate 54, the wire 72 is drawn from the first reel 64 under the urging action of the air cylinder 70, and also the wire 48 wound around the reel 44 is taken up onto the second reel 66. Thus, the belts 52 are taken up on the take-up spools 50 which rotate integrally with the support shaft 42 to allow the fitting plate 54 to ascend automatically. It should be noted that a great stroke of the fitting 54 is designed to be secured using a short-stroke air cylinder 70 by allowing the first reel 64 and the second reel 66** to rotate at different speed ratios.

Further, a stay 74 is extended between the struts 38 at a level below the supporting shaft 42 to be parallel therewith, and guide plates 76 are disposed thereon at the positions corresponding to the positions where the belts 52 are suspended. The guide plates 76 function to guide smoothly the belts 52, when the belts 52 are drawn from or taken up on the take-up spools 50. The fitting plate 54 is designed to locate at the stand-by position assumed in front of the guide plates 76, in the state where the piston rod **70*a* of the cylinder 70** is fully retracted into the barrel, as shown in FIG. 3.

Next, the function of the printing die replacement assisting unit according to the first embodiment of the invention will be described. In the printing die replacement assisting unit 34 assuming the stand-by posture, the piston rod **70*a* of the air cylinder 70 is fully retracted into the barrel to have drawn the wire 72 from the first reel 64, as shown in FIG. 1. Meanwhile, the fitting plate 54 is locating at the stand-by position assumed in front of the guide plates 76**.

Figure 5:
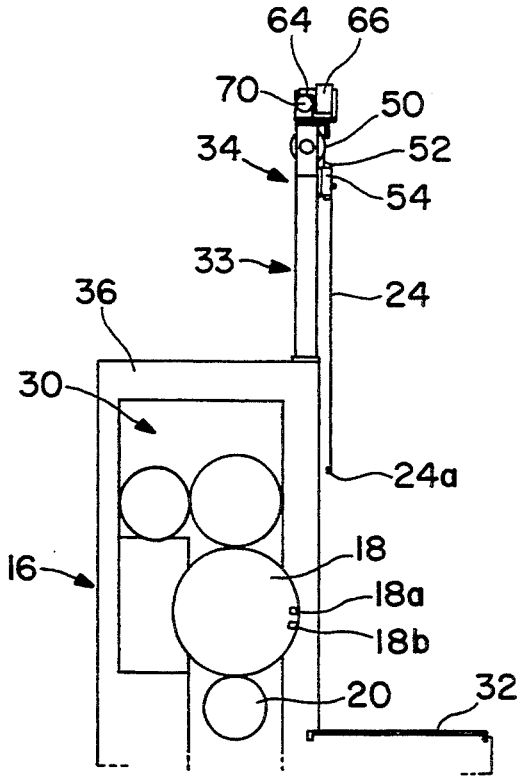
FIG. 5 is an explanatory view showing a step of replacing a printing die using the printing die replacement assisting unit according to the first embodiment of the invention, in which a new printing die is held by and suspended from the fitting plate.

Printing die replacement in accordance with any printing order change and the like is carried out in the following manner. Prior to the printing die replacing operation, a new printing die 24 of the next order is first suspended from the fitting plate 54. Namely, as shown in FIG. 3, the movable leaf **56*b* of the hinge 56 is pivoted to be spaced from the magnets 58 to open the elongated groove 54*a* formed on the front surface of the fitting plate 54. After one of the engagement plates 24*a* of the new printing die 24 is engaged with the elongated groove 54*a*, the movable leaf 56*b* is pivoted to be attracted by the magnets 58, and thus the new printing die 24 can be held by the fitting plate 54** and suspended therefrom, as shown in FIG. 5.

When the printing mechanism 30 of the printing unit 16 is ascended to the halt position in accordance with an order change, the operator climbs on the step 32 and releases the old printing die 24 mounted around the plate cylinder 18 in the printing mechanism 30 to place it on the step 32. The operator then holds the lower end portion of the printing die 24 suspended from the fitting plate 54 and pulls it down. The pair of belts 52 supporting the fitting plate 54 are drawn from the take-up spools 50 as the fitting plate 54 is descended to allow the support shaft 42 and the reel 44 to rotate together with the take-up spools 50. As the reel 44 is rotated, the wire 48 wound around the second reel 66 is taken up on the reel 44. The first reel 64 fitted on the shaft 62 coaxially with the second reel 66 is rotated as the second reel 66 is rotated to take up the wire 72 connected at one end portion to the piston rod 70*a* of the air cylinder 70, whereby the piston rod 70*a* is extended from the barrel against the urging force of the cylinder 70 itself.

Figure 6:
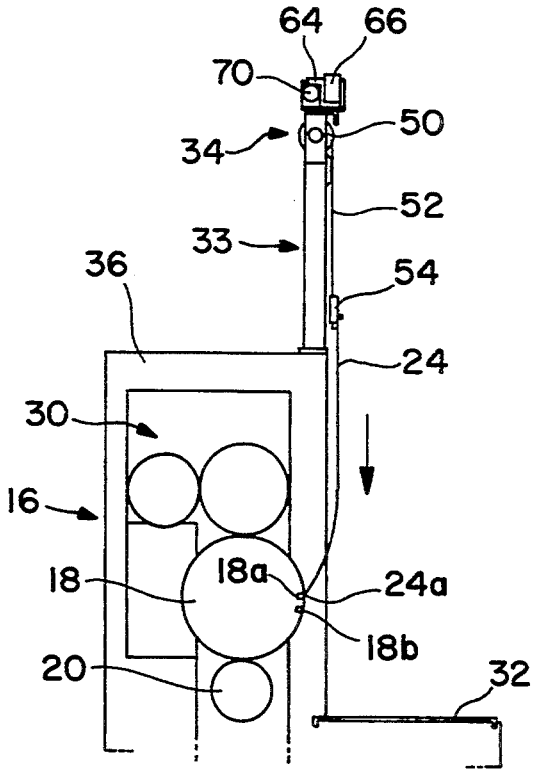
FIG. 6 is an explanatory view showing a step of replacing a printing die using the printing die replacement assisting unit according to the first embodiment of the invention, in which the new printing die suspended from the fitting plate is pulled down.
Figure 7:
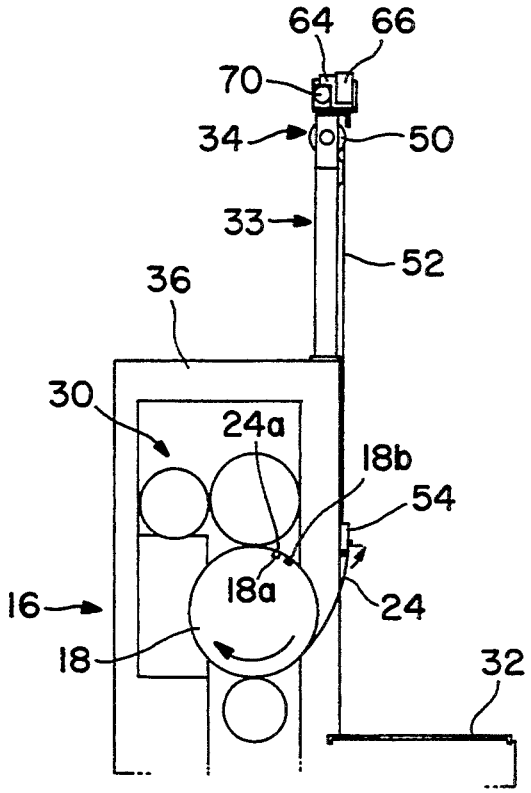
FIG. 7 is an explanatory view showing a step of replacing a printing die using the printing die replacement assisting unit according to the first embodiment of the invention, in which the new printing die suspended from the fitting plate is being rolled around the plate cylinder.

At the stage where the new printing die 24 is descended to a predetermined level, the engagement plate 24*a* disposed to the lower end portion thereof is engaged in the engagement groove 18*a* of the plate cylinder 18, as shown in FIG. 6. The plate cylinder 18 is then turned clockwise to pull down further the fitting plate 54 and allow the new printing die 24 to be rolled around the plate cylinder 18 (see FIG. 7). When the new printing die 24 is substantially rolled around the plate cylinder 18, the movable leaf 56*b* of the hinge 56 fixed on the fitting plate 54 is pivoted to be spaced from the magnets 58 and open the elongated groove 54*a* formed on the front surface of the fitting plate 54. Thus, the engagement plate 24*a* of the new printing die 24 can be disengaged from the elongated groove 54. The thus disengaged engagement plate 24*a* is then clamped by the clamp disposed in the clamping groove 18*b* of the plate cylinder 18 and tightened thereby to complete mounting of the new printing die 24 around the plate cylinder 18.

Figure 8:
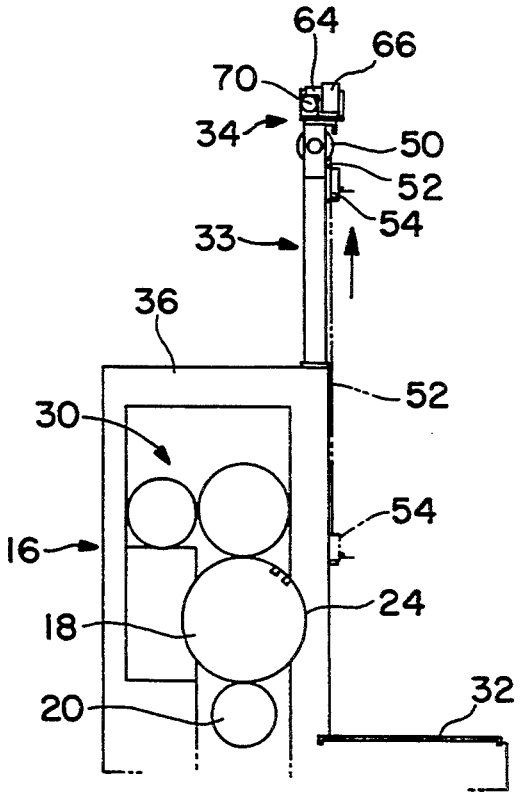
FIG. 8 is an explanatory view showing a step of replacing a printing die using the printing die replacement assisting unit according to the first embodiment of the invention, in which the new printing die is mounted around the plate cylinder, and the fitting plate is ascending to the stand-by position.

Incidentally, when the engagement plate 24*a* of the new printing die 24 is released from the fitting plate 54, the first reel 64 and the second reel 66 are rotated in predetermined directions under the urging action of the air cylinder 70 to take up the wire 48 wound around the reel 44 fitted on the support shaft 42 onto the second reel 66. Thus, the reel 44, the support shaft 42 and the take-up spools 50 are rotated in predetermined directions to take up the belts 52 onto the take-up spools 50, and the fitting plate 54 is ascended to the initial stand-by position, as shown in FIG. 8.

In the printing die replacement assisting unit according to the first embodiment, since the new printing die 24 of the next order can preliminarily be suspended above the plate cylinder 18, the step 32 is prevented from being cluttered with two printing dies, and thus the replacement operation can be facilitated. After the lower engagement plate 24*a* of the new printing die 24 is engaged in the engagement groove 18*a* of the plate cylinder 18 in accordance with the order change, the printing die 24 can smoothly be mounted around the plate cylinder 18, even if the other end portion of the printing die 24 is not held by the operator. Accordingly, one operator can cope with the printing die replacement, even if the printing die is wide, leading to labor saving or reduction.

Figure 9:
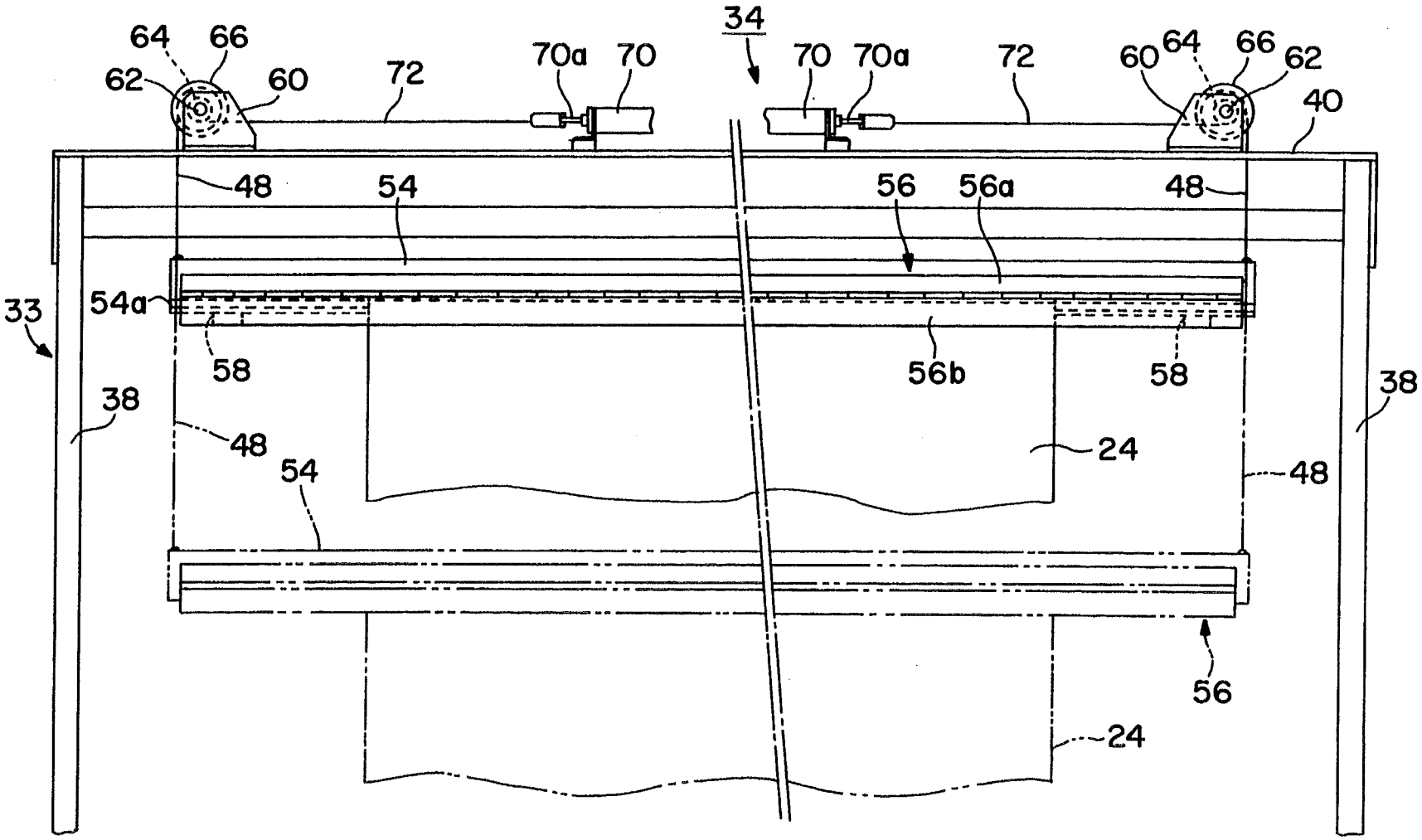
FIG. 9 shows a schematic front view of the printing die replacement assisting unit according to a second embodiment of the invention.

FIG. 9 shows a printing die replacement assisting unit according to a second embodiment of the invention, in which two air cylinders 70 are disposed on the support plate 40 in opposite directions, and two holders 60 each rotatably supporting a first reel 64 and a second reel 66 are also disposed on the supporting plate 40 near the longitudinal end portions thereof. The end portion of a wire 72 drawn from the first reel 64 is connected to the piston rod 70*a* of the corresponding air cylinder 70; whereas the end portion of a wire 48 wound around the second reel 66 is connected to the upper end of the fitting plate 54 at the corresponding longitudinal end portion. Namely, in the second embodiment, the fitting plate 54 is suspended by the wires 48 wound around the second reels 66, so that the fitting plate 54 can be ascended or descended by drawing or winding the wires 48. Incidentally, with respect to the mechanism of gripping the printing die 24 to be disposed to the fitting plate 54, the same mechanism as shown in FIG. 1 is employed.

Figure 10:
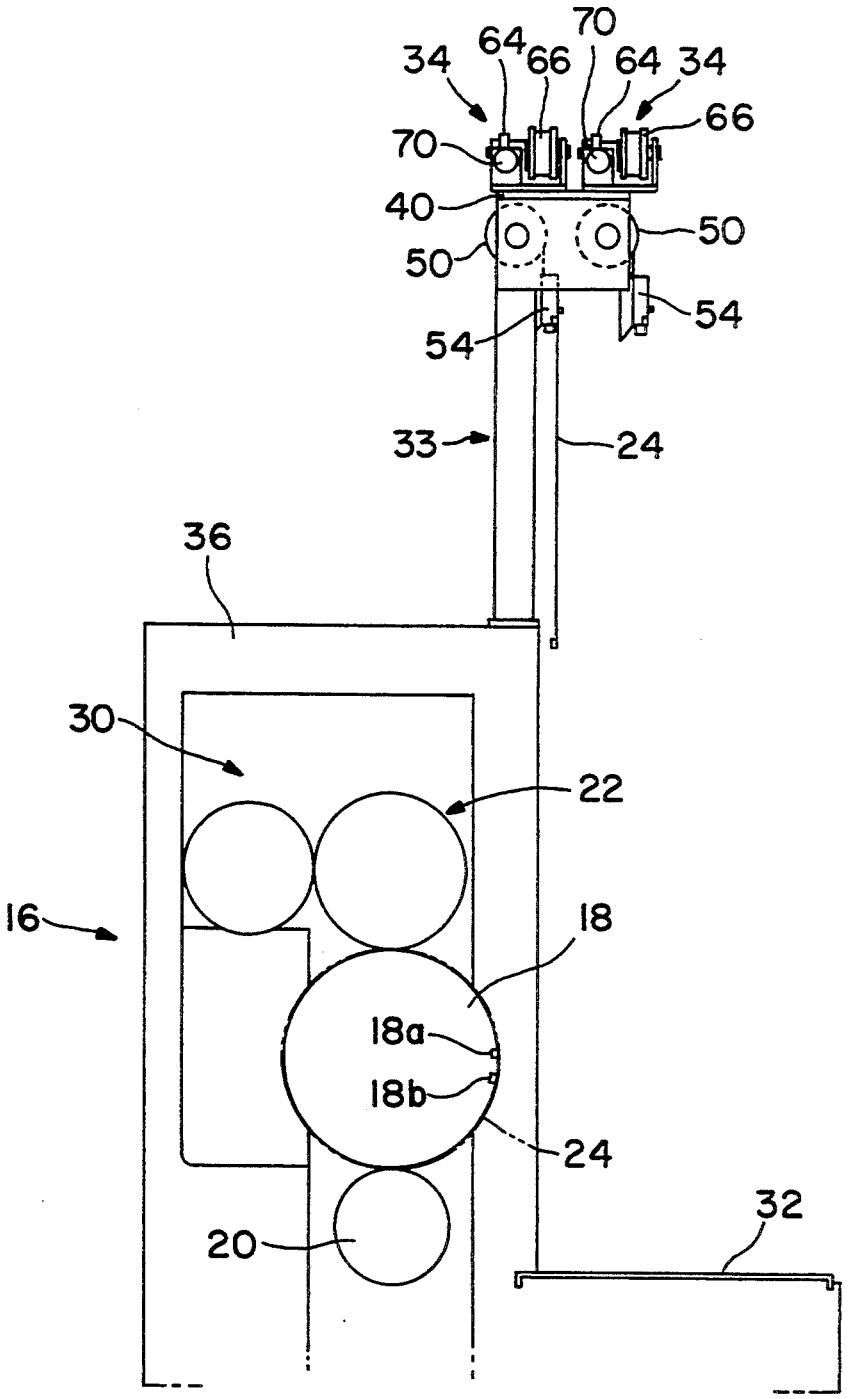
FIG. 10 shows a schematic side view of the printing die replacement assisting unit according to a third embodiment of the invention.

Meanwhile, FIG. 10 shows a printing die replacement assisting unit according to a third embodiment of the invention, in which two printing die replacement assisting units 34 are disposed parallelwise on the support plate 40 being arranged in the direction of feeding corrugated board sheets. In the third embodiment, a new printing die 24 of the next order is preliminarily held by and suspended from, for example, a first printing die replacement assisting unit 34 locating on the left side in FIG. 10. One engagement plate 24*a* of the old printing die 24 is released from the plate cylinder 18, and the fitting plate 54 in a second printing die replacement assisting unit 34 locating on the right side is pulled down to a predetermined level, on which the thus released engagement plate 24*a* of the old printing die 24 is allowed to be retained. Subsequently, the plate cylinder 18 is turned in a predetermined direction (counterclockwise), and thus the old printing die 24 is pulled up together with the fitting plate 54 under the urging action of the air cylinder 70 to be released from the plate cylinder 18. Then, the new printing die 24 suspended from the first printing die replacement assisting unit 34 can easily be mounted around the plate cylinder 18 in the same manner as in the preceding embodiments. Thus, the step 32 is prevented from being occupied with the hampering old printing die 24 released from the plate cylinder 18.

While the printing die replacement assisting unit of the invention is employed in the printing apparatus in which the printing mechanism of the printing unit is designed to be descendable in the embodiments described above, the present invention is not limited to such constitution. The printing die replacement assisting unit may also be employed in a printing apparatus, for example, of a type in which the printing units are moved to be spaced from each other to define a predetermined space therebetween, and the printing die replacement is carried out in this space. Further, the printing die replacement assisting unit can of course be employed in a printing apparatus provided with only one printing unit. While air cylinder is used as the means for normally urging the fitting plate upward in the above embodiments, the cylinder may be replaced with other suitable means such as a motor.

It will be apparent to those skilled in the art that the present invention may be embodied in many other specific forms without departing from the spirit or scope of the invention. Therefore, the present embodiment are to be considered as illustrative and not restrictive and the invention is not to be limited to the details given herein, but may be modified within the scope of the appended claims.

What is claimed is:

1. A printing die replacement assisting unit for a printing apparatus in which a plate cylinder is rotatably supported in the main body of said apparatus with a printing die having engagement plates on each end portion with respect to the rolling direction being mounted on the circumference of said plate cylinder, said printing die replacement assisting unit comprising:

a support frame disposed on said main body, with a fitting member being descendably supported on supporting means disposed on said support frame;

holding means disposed to said fitting member, which can releasably hold one of said engagement plates of said printing die; and an urging means connected to said supporting means, which normally urges said means in the direction such that the fitting member may be ascended, but allows pulling down of said fitting member;

wherein said printing die is designed to be held by and suspended from said fitting member via said holding means.

2. The printing die replacement assisting unit according to claim 1, wherein said fitting member has an elongated groove formed thereon in which said engagement plate of said printing die can releasably be engaged and a hinge fixed thereon in such a way that one leaf thereof may be pivotable; said movable leaf being designed to be able to open or close said elongated groove and to be retained at a position such that it can close said elongated groove when attracted by magnets disposed on said fitting member, whereby said printing die is adapted to be held on said fitting member by allowing said movable leaf to be attracted by said magnets, with said engagement plate of said printing die being engaged in said elongated groove.

3. The printing die replacement assisting unit according to claim 1 or 2, wherein a support shaft is rotatably supported on said support frame to extend parallel to said plate cylinder, and a plurality of take-up spools are fitted on said support shaft to be rotatable integrally therewith, with said fitting member being attached to each end portion of predetermined lengths of belts wound around said take-up spools.

4. The printing die replacement assisting unit according to claim 3, wherein a first reel and a second reel, which are integrally rotatable, are disposed on said support frame, and the end portion of a wire wound around said first reel is connected to said urging means, whereas the end portion of a wire wound around said second reel is connected to said reel disposed to be rotatable integrally with said support shaft and to be taken up thereon.

5. The printing die replacement assisting unit according to claim 1 or 2, wherein a plurality of holding members each holding thereon a first reel and a second reel, which are integrally rotatable, are disposed on said frame, and one end portion of a wire wound on said first reel is connected to a corresponding urging means, while one end portion of a wire wound around said second reel is connected to said fitting member.

6. The printing die replacement assisting unit according to claim 4, wherein one end portion of said wire wound around said first reel is connected to a piston rod of an air cylinder disposed on said support frame.

7. The printing die replacement assisting unit according to claim 5, wherein one end portion of said wire wound around said first reel is connected to a piston rod of an air cylinder exposed on said support frame.

* * * * *